US008328699B2

(12) United States Patent
Park

(10) Patent No.: US 8,328,699 B2
(45) **Date of Patent: *Dec. 11, 2012**

(54) EXERCISING AIR FOOTBOARD AND BUFFER FOR AIR FOOTBOARD

(75) Inventor: Hee-sun Park, Goyang-si (KR)

(73) Assignee: Equbic Product Company, LLC, Rockville, MD (US)

( * ) Notice: Subject to any disclaimer, the term of this patent is extended or adjusted under 35 U.S.C. 154(b) by 839 days.

This patent is subject to a terminal disclaimer.

(21) Appl. No.: 11/603,248

(22) Filed: Nov. 22, 2006

(65) Prior Publication Data

US 2007/0155591 A1 Jul. 5, 2007

Related U.S. Application Data

(63) Continuation of application No. 10/491,968, filed as application No. PCT/KR02/01979 on Oct. 23, 2002, now Pat. No. 7,160,229.

(30) Foreign Application Priority Data

Oct. 29, 2001 (KR) ..... 20-2001-33045 U
Feb. 18, 2002 (KR) ..... 10-2002-8484
Oct. 7, 2002 (KR) ..... 20-2002-29872 U

(51) Int. Cl.
*A63B 21/02* (2006.01)

(52) U.S. Cl. ..... 482/121; 482/52; 482/77

(58) Field of Classification Search ..... 482/23, 482/26, 27, 30, 31, 52, 53, 77, 79, 80, 92, 482/110–112, 121–123, 146–148; 446/220, 446/221; 5/615; 297/DIG. 8, 423.46; 248/560, 248/562; 273/449; 73/865.4; 601/23, 24; 434/258

See application file for complete search history.

(56) References Cited

U.S. PATENT DOCUMENTS 3,125,377 A * 3/1964 Bridges ..... 297/462
3,167,312 A * 1/1965 Blanchard ..... 482/128
3,263,247 A * 8/1966 Knittel et al. ..... 267/117
3,884,463 A 5/1975 Malatesta
4,084,811 A * 4/1978 Kyo ..... 482/83
4,204,675 A * 5/1980 McGinnis ..... 482/80
4,635,931 A * 1/1987 Brannstam ..... 482/112

(Continued)

FOREIGN PATENT DOCUMENTS

GB 2131517 A 6/1984

(Continued)

OTHER PUBLICATIONS

PCT Intl. Search Report, Feb. 17, 2003, Hee-Sun Park.

(Continued)

*Primary Examiner* — Loan Thanh
*Assistant Examiner* — Tam Nguyen
(74) *Attorney, Agent, or Firm* — Blank Rome LLP

(57) ABSTRACT

An exercise step with air-cushioning legs. The exercise step (1) includes a plate-shaped panel (10), and air-cushioning legs (30). Each of the air-cushioning legs is provided under the panel to support the panel, and absorbs a load applied to the panel by air cushioning effect. The exercise step has a high air cushioning effect, thus protecting a user's knees from injury, allowing the user to exercise in comfort and safety, and minimizing noise generated during a cushioning operation. Further, the exercise step prevents the panel from being deformed due to a load applied to the panel.

11 Claims, 11 Drawing Sheets

U.S. PATENT DOCUMENTS

| | | | | | |
|---|---|---|---|---|---|
| 5,186,700 | A | | 2/1993 | Wang | |
| 5,256,118 | A | | 10/1993 | Chen | |
| 5,267,923 | A | * | 12/1993 | Piaget et al. | 482/53 |
| 5,346,444 | A | * | 9/1994 | Hsieh | 482/53 |
| 5,441,466 | A | * | 8/1995 | Piaget et al. | 482/52 |
| 5,575,738 | A | * | 11/1996 | Millington et al. | 482/35 |
| 5,626,543 | A | | 5/1997 | Chen | |
| 5,813,946 | A | * | 9/1998 | Lin et al. | 482/27 |
| 5,851,166 | A | * | 12/1998 | Bernardson | 482/79 |
| 6,024,678 | A | * | 2/2000 | Solomon | 482/111 |
| 6,126,152 | A | | 10/2000 | Santos et al. | |
| 7,160,229 | B2 | * | 1/2007 | Park | 482/52 |
| 2002/0160890 | A1 | * | 10/2002 | Fazio et al. | 482/112 |
| 2009/0227427 | A1 | * | 9/2009 | Park | 482/52 |

FOREIGN PATENT DOCUMENTS

| | | | |
|---|---|---|---|
| JP | 02-109662 | | 9/1990 |
| JP | 06-058964 | | 8/1994 |
| JP | 10-155508 | | 6/1998 |
| JP | 2001-37907 | A | 2/2001 |
| KR | 1998-28600 | U | 8/1998 |
| KR | 1999-16108 | U | 5/1999 |
| KR | 2001-847 | U | 1/2001 |
| KR | 2001-242870 | Y | 10/2001 |

OTHER PUBLICATIONS

PCT Intl. Prelim Exam Rpt, Feb. 19, 2004, Hee-Sun Park.
JP Office Action, Nov. 7, 2007, Hee-Sun Park.

* cited by examiner

EXERCISING AIR FOOTBOARD AND BUFFER FOR AIR FOOTBOARD

CROSS-REFERENCE TO RELATED APPLICATION

This patent application is a continuation of U.S. patent application Ser. No. 10/491,968 filed Sep. 21, 2004, now U.S Pat. No. 7,160,229. U.S. application Ser. No. 10/491,968 is a national stage entry of PCT/KR02/01979 having an international filing date of Oct. 23, 2002, which is incorporated herein by reference in its entirety.

TECHNICAL FIELD

The present invention relates, in general, to an exercise step and an air-cushioning leg for the exercise step and, more particularly, to an exercise step which is designed to have an excellent air cushioning effect, thus protecting a user's knees from injury and allowing the user to exercise in comfort and safety, and which is designed to minimize noise generated during a cushioning operation.

BACKGROUND ART

FIG. 1 is perspective view of a conventional exercise step. As shown in the drawing, the conventional exercise step 100 includes a rectangular panel 110, and four legs 130. The legs 130 are provided at four corners of the panel 110 under the panel 110, and are made of elastic materials. A foot contact plate 120 is provided at a top surface of the panel 110. Actually, a user's feet are in contact with the foot contact plate 120 of the panel 110.

When one desires to exercise using the exercise step 100, the exercise step 100 having such a construction is placed on a flat surface, that is, a floor. Thereafter, a user repeatedly steps onto and off of the foot contact plate 120 of the panel 110. Or, the user jumps on the foot contact plate 120. At this time, a load of the user is transmitted from the foot contact plate 120 and the panel 110 through the legs 130 to the support surface.

In this case, the legs 130 are elastically deformed to absorb a load applied to the panel 110, thus preventing a shock from being transmitted to the user's knees. That is, such an exercise step 100 prevents a user's knees from being injured, when the user repeatedly steps onto and off of the foot contact plate 120 or jumps on the foot contact plate 120 of the exercise step 100.

However, the conventional exercise step 100 has a problem that only the legs 130 are made of a cushioning material, such as polyurethane, so a cushioning capacity of the exercise step 100 is insufficient to prevent a shock from being transmitted to a user's knees. Thus, the conventional exercise step 100 does not sufficiently prevent a shock from being transmitted to a user's knees and allow the user to exercise safely and comfortably.

Further, the conventional exercise step 100 has another problem that only the legs 130 have a cushioning capacity, so the foot contact plate 120 and the panel 110 may be undesirably deformed when the exercise step 100 is used for a lengthy period of time. The conventional exercise step 100 has a further problem that the cushioning capacity of the legs 130 is not controlled, so a different exercise step must be purchased according to a user's weight.

DISCLOSURE OF THE INVENTION

Accordingly, the present invention has been made keeping in mind the above problems occurring in the prior art, and an object of the present invention is to provide an exercise step with air-cushioning legs, which has an excellent air cushioning effect, thus protecting a user's knees from injury and allowing the user to exercise in comfort and safety.

Another object of the present invention is to provide an exercise step with air-cushioning legs, which is designed to minimize noise generated during a cushioning operation and have an excellent cushioning effect.

A further object of the present invention is to provide an exercise step with air-cushioning legs, which is designed to prevent a panel from being undesirably deformed due to a user's load.

Still another object of the present invention is to provide an exercise step with air-cushioning legs, which is designed to allow a user to check the number of steps and an exercise time while exercising.

In order to accomplish the above object, the present invention provides an exercise step, including a plate-shaped panel, and an air-cushioning leg provided under the panel to support the panel and absorbing a load applied to the panel by an air cushioning effect.

Further, in order to accomplish the above object, the present invention provides an air-cushioning leg for an exercise step, which is provided under a support unit to absorb a load applied to the support unit, and which includes a main body having a double-or more-layered structure and an air control unit functioning to discharge a part of cushioning air from the main body to the outside, when a load is applied to the support unit.

In order to accomplish the above object, the present invention provides an air-cushioning leg for an exercise step, which is provided under a support unit to absorb a load applied to the support unit, and which includes a main body having a plurality of tubular bulged parts having different capacities, the bulged parts arranged to form a layered structure, a closed base part coming into contact with a support surface, and an upper end partially opened to define an air passage, an air control unit seated in the open part of the upper end to control an amount of air which flows in and out the main body, and a cover member covering the upper end of the main body in which the air control unit is seated.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
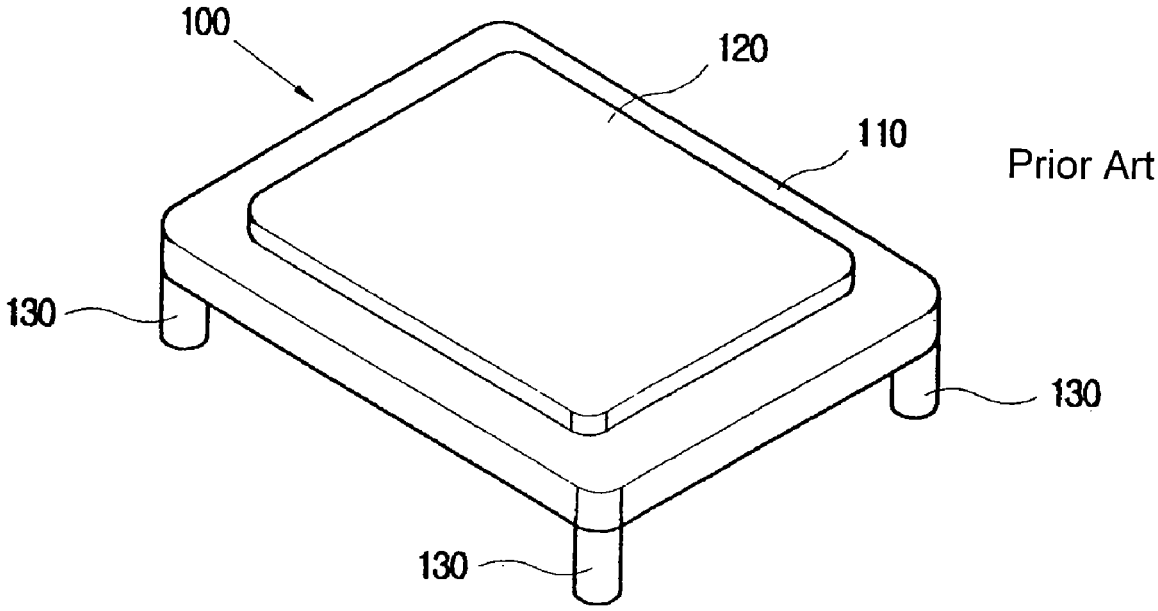
FIG. 1 is a perspective view of a conventional exercise step.

Reference should now be made to the drawings, in which the same reference numerals are used throughout the different drawings to designate the same or similar components.

Figure 2:
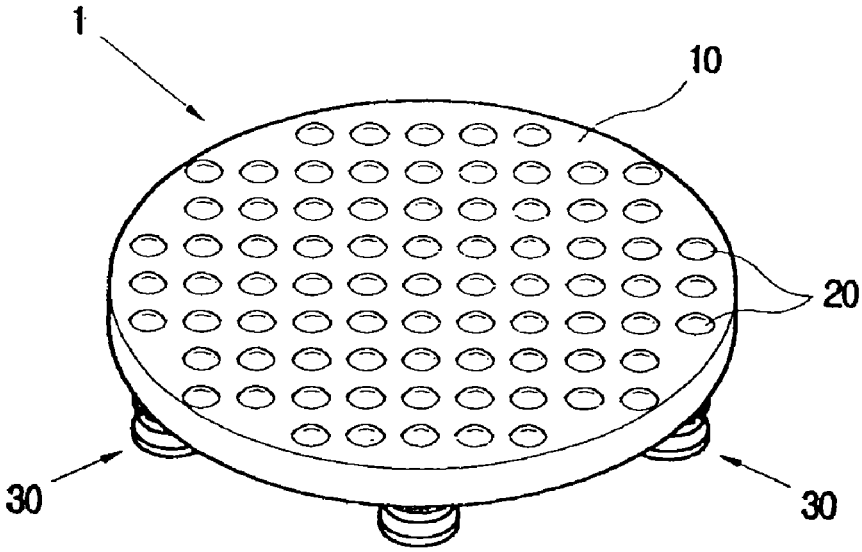
FIG. 2 is a perspective view of an exercise step according to a primary embodiment of the present invention.
Figure 3:
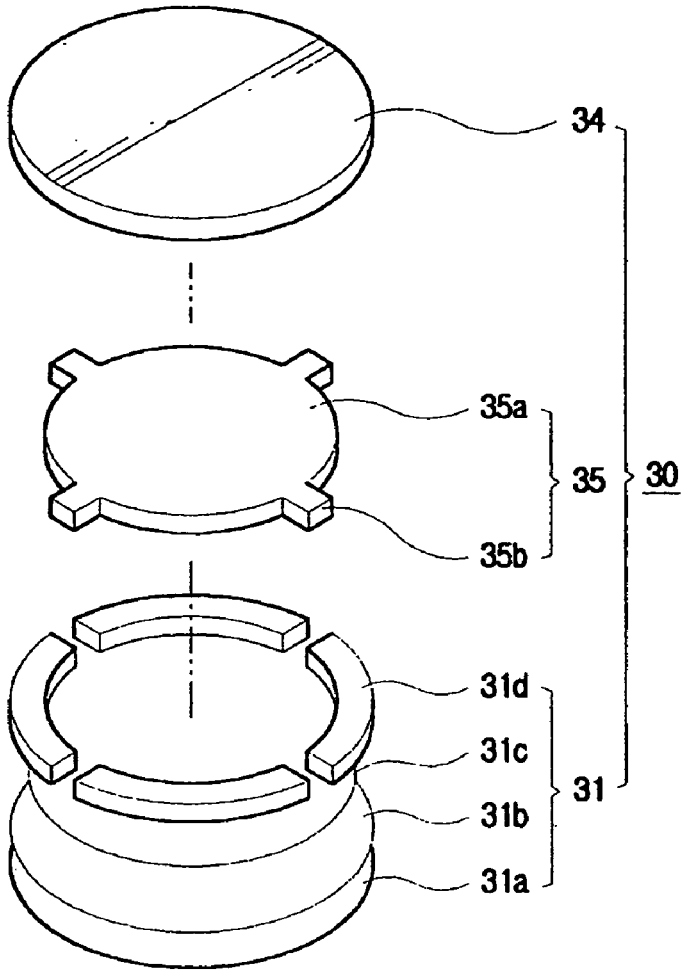
FIG. 3 is an exploded perspective view of an air-cushioning leg shown in FIG. 2.

FIG. 2 is a perspective view of an exercise step according to a primary embodiment of the present invention. As shown in the drawing, an exercise step 1 according to the primary embodiment of the present invention includes a plate-shaped panel 10 and four air-cushioning legs 30. The air-cushioning legs 30 are mounted to four comers of the panel 10 under the panel 10.

A plurality of embossments 20 are formed on a top surface of the panel 10. The embossments 20 prevent a user from slipping and falling on the panel 10 during an exercise, in addition to functioning to massaging the sole of the user's foot. The embossments 20 may be separately manufactured and mounted to the top surface of the panel 10. Preferably, the embossments 20 are integrated with the panel 10 to form a single structure.

The panel 10 is a kind of laminated compressed wood, and is fabricated by processing multi-layered sheets to which a synthetic resin is added, under high temperature and high pressure. When the panel 10 is manufactured in this way, the panel 10 is somewhat hard, and has excellent elasticity and elastic strain, so the panel 10 is not easily damaged or deformed.

A plurality of air-cushioning legs 30 are provided at four corners of the panel 10 under the panel 10 to absorb the load applied to the panel 10. The air-cushioning legs 30 may be glued to the panel 10 under the panel 10. Alternatively, the air-cushioning legs 30 may be screwed to the panel 10 under the panel 10.

As shown in FIGS. 3 and 4*a* to 4*c*, each of the air cushioning legs 30 includes a main body 31, an air control unit 35, and a cover member 34. The main body 31 has a plurality of tubular bulged parts 31*b* and 31*c* which have different capacities and are arranged to form a layered structure. The main body 31 also has a base part 31*a* and an upper end 31*d*. The base part 31*a* is closed and comes into contact with a support surface. The upper end 31*d* is partially opened to define an air passage. The air control unit 35 is seated in an open part 33 of the upper end 31*d* to control an amount of air which flows in and out the main body 31. The cover member 34 covers the upper end 31*d* of the main body 31 in which the air control unit 35 is seated.

Figure 4A:
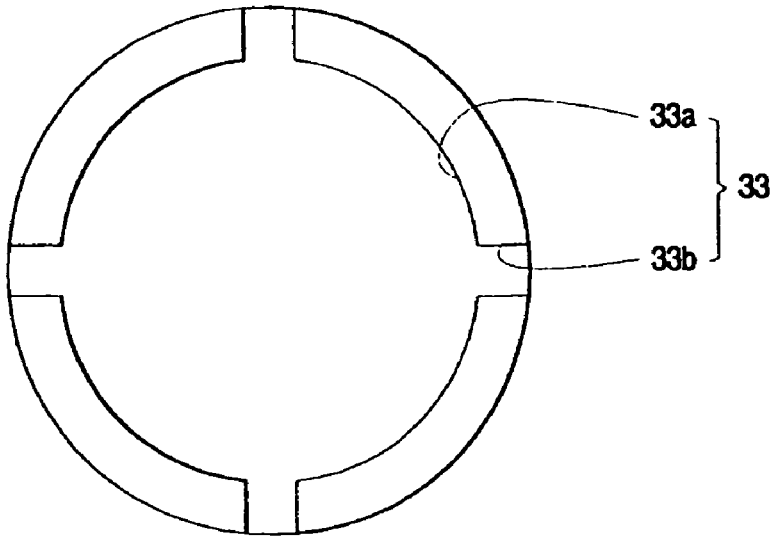
FIGS. 4*a* to 4*c* are a plan view, a side sectional view, and a bottom view of the air-cushioning leg shown in FIG. 3, respectively.

As shown in FIG. 4*a*, the open part 33 of the upper end 31*d* of the main body 31 includes a central opening 33*a*, and a plurality of radial slits 33*b*. The central opening 33*a* is formed at the center of the upper end 31*d* of the main body 31. The radial slits 33*b* are provided along the circumference of the upper end 31*d* of the main body 31 at predetermined intervals in such a way as to communicate with the central opening 33*a*. A single radial slit may be formed, but it is preferable that a plurality of radial slits are formed, like the primary embodiment of the present invention.

That is, when a user steps onto or jumps on the panel 10, air is discharged from the main body 31 through the central opening 33*a* and the radial slits 33*b* to the outside. Subsequently, the bulged parts 31*b* and 31*c* are compressed to absorb the load applied to the panel 10.

In the case where only the open part 33 is formed at the upper end 31*d* of the main body 31, air excessively easily flows in and out the main body 31, so the load applied to the panel 10 is not effectively absorbed. Thus, according to the present invention, the air control unit 35, which is made of a porous material, such as a sponge, is seated in the open part 33.

Figure 5A:
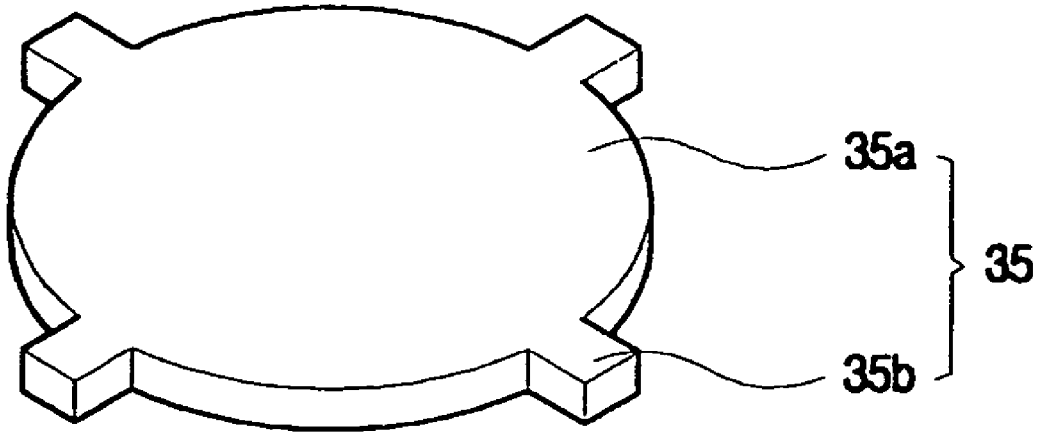
FIG. 5*a* is a perspective view of an air control unit included in the air-cushioning leg of the primary embodiment of the present invention.

As shown in FIG. 5*a*, the air control unit 35 includes a control body 35*a*, and a plurality of flanges 35*b*. The control body 35*a* is seated in the central opening 33*a*. The flanges 35*b* outwardly extend from the control body 35*a* in a radial direction to be seated in the radial slits 33*b*.

When a user steps onto or jumps on the panel 10 after the air control unit 35 is seated in the open part 33 of the upper end 31*d* of the main body 31, air is discharged from the main body 31 through the control body 35*a* seated in the central opening 33*a* and the flanges 35*b* seated in the radial slits 33*b* to the outside. Simultaneously, the bulged parts 31*b* and 31*c* are compressed to absorb the load applied to the panel 10. According to the present invention, since the air control unit 35 is made of a porous material, noise is not generated even when air flows in and out the main body 31, thus allowing a user to exercise in comfort and safety.

Figure 5B:
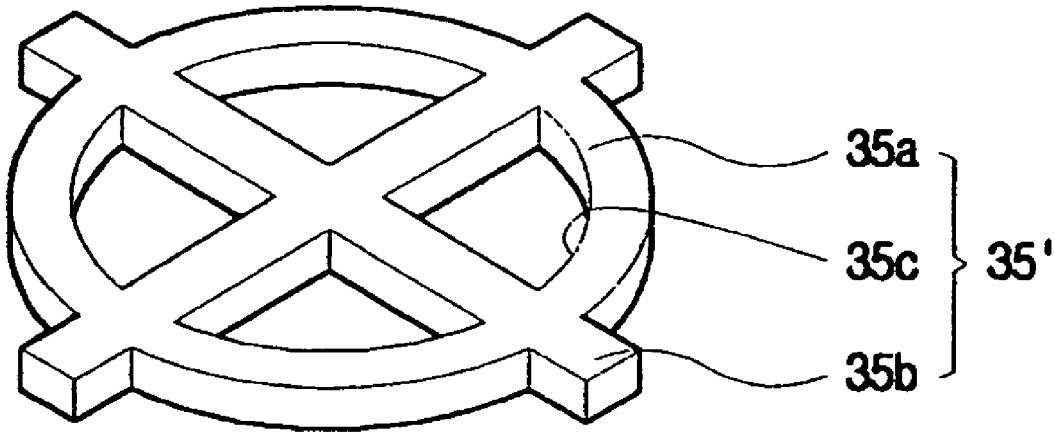
FIG. 5*b* is a perspective view of an air control unit according to a modification of the primary embodiment of the present invention.

Meanwhile, as shown in FIG. 5*b*, an air control unit 35' may have a shape different from the air control unit 35 of FIG. 5*a*. That is, a plurality of through holes 35*c* are provided in the control body 35*a* to additionally control the amount of air which flows in and out the main body 31. In this case, the shape and number of the through holes 35*c* may be changed.

The air control unit 35' having a plurality of the through holes 35*c* in the control body 35*a* as shown in FIG. 5*b*, has a higher cushioning effect in comparison with the air control unit 35 of FIG. 5*a*. Thus, the air-cushioning leg 30 equipped with the air control unit 35 of FIG. 5*a* is suitable for heavy adults, whereas the air-cushioning leg 30 equipped with the air control unit 35' of FIG. 5*b* is suitable for light adults and children.

Figure 4B:
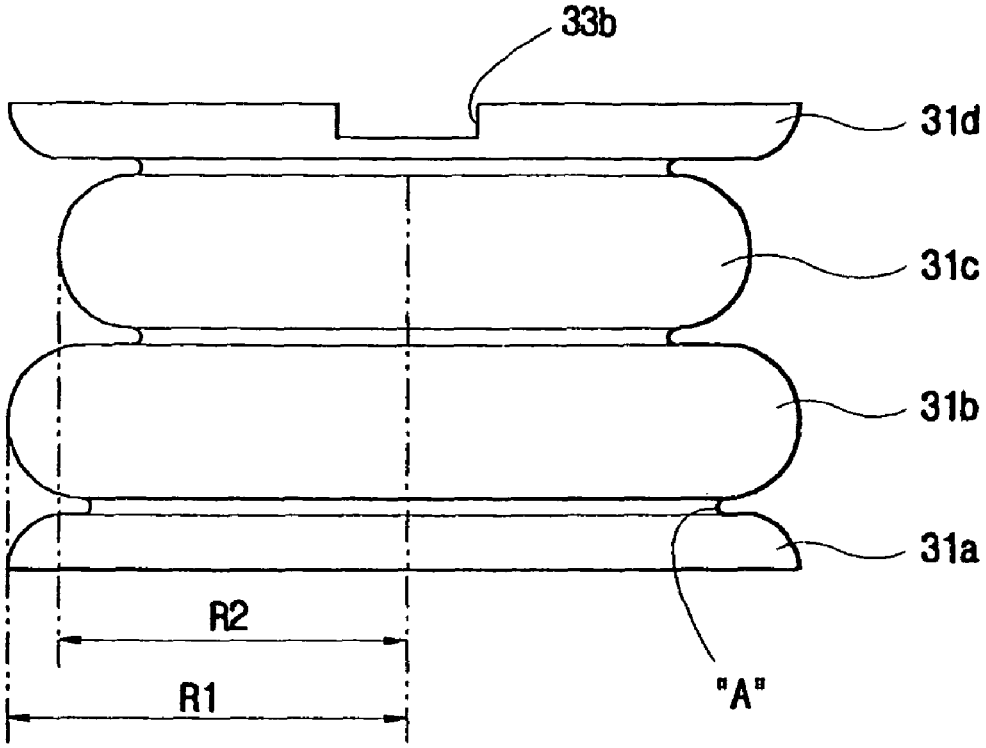

As shown in FIG. 4*b*, the bulged parts 31*b* and 31*c* comprise a first bulged part 31*b* and a second bulged part 31*c*. The first bulged part 31*b* is provided adjacent to the base part 31*a* of the main body 31. The second bulged part 31*c* is placed on the first bulged part 31*b* to form a layered structure.

As shown in FIG. 4*b*, it is preferable that the radius R1 of the first bulged part 31*b* is larger than the radius R2 of the second bulged part 31*c* to maintain a high cushioning effect and stability. Further, it is preferable that junctions between the base part 31*a*, the first and second bulged parts 31*c* and 31*d*, and the upper end 31*b* are constricted and inwardly rounded (see, "A"), thus allowing the main body 31 to be smoothly compressed. Of course, the radius R1 of the first bulged part 31*b*, the radius R2 of the second bulged part 31*c*, and the capacities of the first and second bulged parts 31*b* and 31*c* must be properly determined according to the size of the panel 10 and the magnitude of the load, but such variations are not described herein in detail.

Figure 4C:
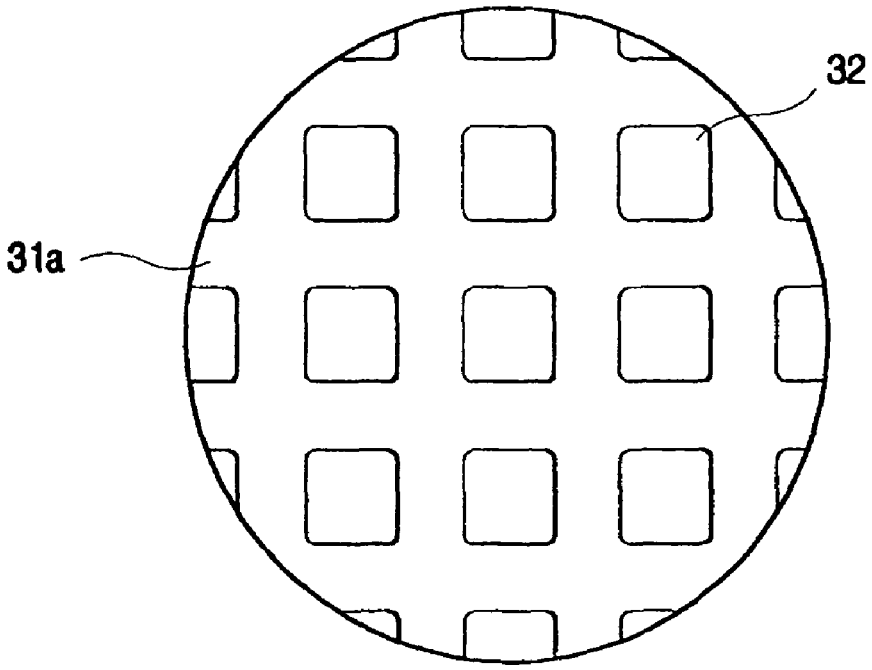

As shown in FIG. 4*c*, a plurality of foot parts 32 are projected from a bottom surface of the base part 31*a* of the main body 31, thus preventing the base part 31*a* of the main body 31 from being compressed due to the load. According to the primary embodiment of the present invention, the foot parts 32 each have a rectangular block shape. However, the foot parts 32 may have a different shape without being limited to the rectangular block shape.

The use of the exercise step 1 constructed in this way will be described in the following.

First, the exercise step 1 is placed on a flat surface, that is, a floor. Next, when a user repeatedly steps onto and off of the panel 10 or jumps on the panel 10, the load applied to the panel 10 is transmitted to the support surface through the panel 10 and the air-cushioning legs 30.

At this time, the load applied to the panel 10 is absorbed by the panel 10 to some extent, but the load is mostly absorbed by the air-cushioning legs 30. That is, when the user compresses the panel 10, air is discharged from the main body 31 through the control body 35*a* seated in the central opening 33*a* and the flanges 35*b* seated in the radial slits 33*b* to the outside. Simultaneously, the second bulged part 31*c* is downwardly compressed toward the first bulged part 31*b*, thus absorbing the load applied to the panel 10.

In this case, each of the air-cushioning legs 30 is provided with the air control unit 35 which is made of a porous material, thus preventing noise from being generated even when. air is discharged from the main body 31 to the outside, therefore allowing a user to enjoy exercising in comfort and safety.

Of course, as described above, the air-cushioning leg 30 equipped with the air control unit 35 of FIG. 5*a* is suitable for heavy adults, whereas the air-cushioning leg 30 equipped with the air control unit 35' of FIG. 5*b* is suitable for light adults and children.

As such, the exercise step 1 equipped with the air-cushioning legs 30 minimize noise generated during a cushioning operation, and has an excellent cushioning effect, thus protecting a user's knees from injury and allowing the user to exercise in comfort and safety.

Figure 6:
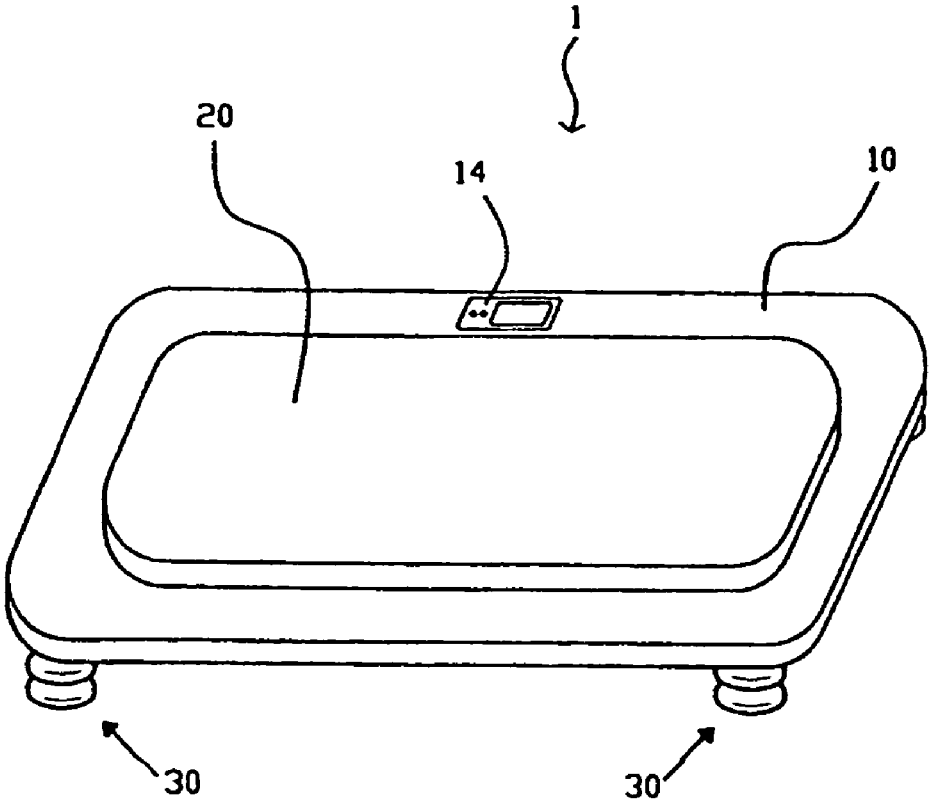
FIG. 6 is a perspective view of an exercise step according to a second embodiment of the present invention.

As shown in FIG. 6, an exercise step 1 according to a second embodiment of the present invention includes a rectangular plate-shaped panel 10 and a plurality of air-cushioning legs 30. The air-cushioning legs 30 are mounted to four corners of the panel 10 under the panel 10. A rectangular foot contact plate 20 is provided on a top surface of the panel 10. The foot contact plate 20 is made of an elastic material, such as rubber, thus giving comfort to a user and having some cushioning effect.

The panel 10 is a kind of laminated compressed wood, and is fabricated by processing multi-layered sheets to which a synthetic resin is added, under high temperature and high pressure. Thus, the panel 10 is somewhat hard, and has excellent elasticity and elastic strain, so the panel 10 is not easily damaged or deformed.

A display unit 14 is provided at a predetermined portion of the panel 10. The display unit 14 is connected to a control unit (not shown), and displays at least one of the number of steps and a time. Thus, a user may set the number of steps and a time as desired when exercising.

Figure 7:
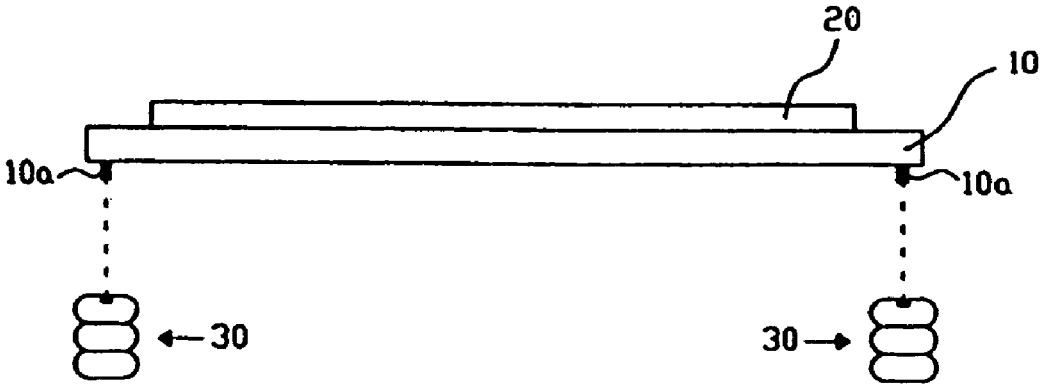
FIG. 7 is a side sectional view showing a part of the exercise step shown in FIG. 6, in which air-cushioning legs are removed from a panel.
Figure 8A:
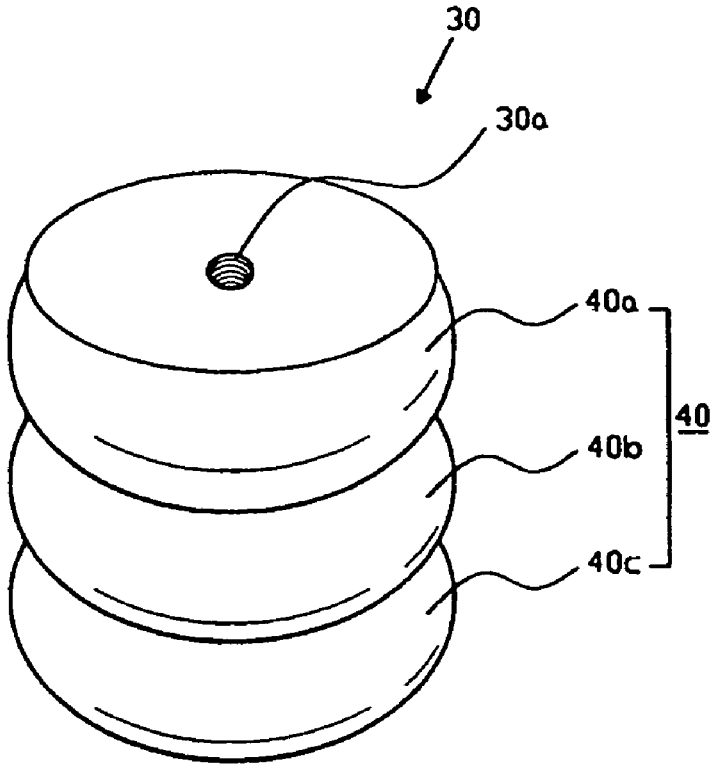
FIGS. 8*a* and 8*b* are perspective views of one of the air-cushioning legs included in the exercise step shown in FIG. 6, respectively.

As shown in FIG. 7, a plurality of bolts 10*a* are provided at four corners of the panel 10 under the panel 10. Each aircushioning leg 30 is provided with a bolt receiving part 30*a* so that the bolt 30*a* is tightened into the bolt receiving part 30*a* (see, FIG. 8*a*). That is, by tightening the bolts 10*a* of the panel 10 into the bolt receiving parts 30*a* of the air-cushioning legs 30, the air-cushioning legs 30 are easily mounted to the panel 10.

Although not shown in the drawings, the positions of the bolts 10*a* and the bolt receiving parts 30*a* may be changed That is, the bolts 10*a* may be provided on the air-cushioning legs 30, while the bolt receiving parts 30*a* may be provided on the bottom surface of the panel 10.

The air-cushioning legs 30 are provided under the panel 10 to support it, and absorb the load applied to the panel 10. Each of the air-cushioning legs 30 includes a main body 40 and an air control unit 50. The main body 40 is made of a material, such as polyurethane. The air-control unit 50 functions to discharge a part of cushioning air from the main body 40 to the outside, when the load is applied to the panel 10.

The main body 40 may have a two-layered structure having two bulged parts or a multi-layered structure having four or more bulged parts. However, according to the second embodiment of the present invention, the main body 40 has three bulged parts 40*a*, 40*b*, and 40*c*, which are layered in a vertical direction.

Figure 8B:
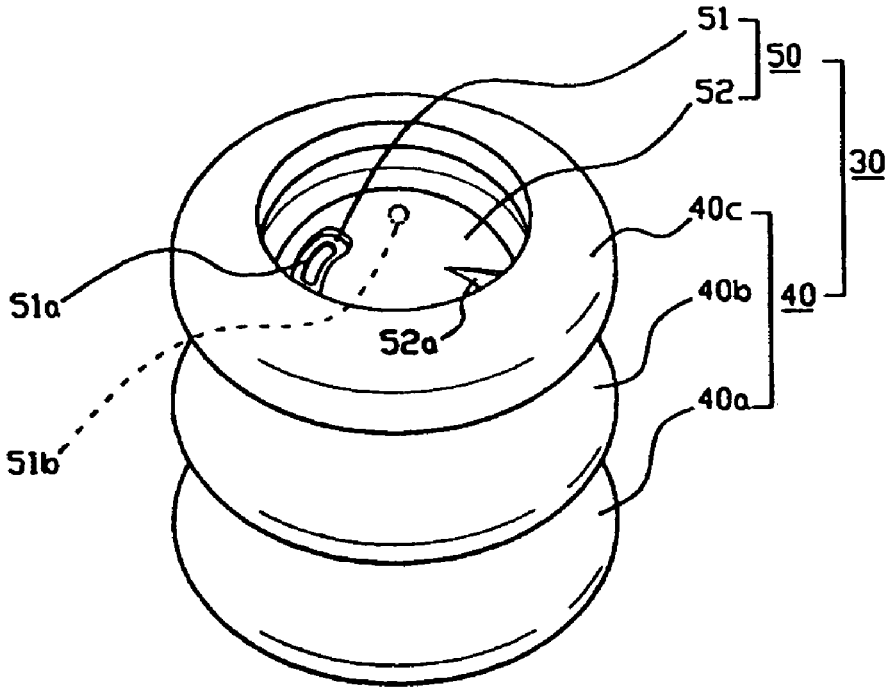

As shown in FIG. 8*b*, the air control unit 50 according to the second embodiment of the present invention includes a cover part 51 and a control part 52. The cover part 51 covers an open part of the main body 40. Air flow holes 51*a* and 51*b* of different sizes are formed in the cover part 51. The control part 52 is rotatably mounted to the cover part 51 to selectively open or close. the air flow holes 51*a* and 51*b*. Preferably, the control part 52 is provided with a handle 52*a*.

When a heavy adult uses the exercise step 1 of the present invention, the control part 52 is rotated to open a smaller air flow hole 51*a*. On the contrary, when a light child uses the exercise step 1 of the present invention, the control part 52 is rotated to open a larger air flow hole 51*b*. Thus, the exercise step 1 of the present invention allows a cushioning effect to be controlled according to the user's load.

The use of the exercise step 1 according to the second embodiment of the present invention will be described in the following.

First, the exercise step 1 is placed on a flat surface, that is, a floor. Next, when a user repeatedly steps onto and off of the foot contact plate 20 of the panel 10 or jumps at a fixed position on the foot contact plate 20, the load applied to the panel 10 is transmitted to the support surface through the panel 10 and the air-cushioning legs 30.

At this time, the load applied to the panel 10 is absorbed by the panel 10 and the foot contact plate 20 to some extent, but the load is mostly absorbed by the air-cushioning legs 30. That is, the load is primarily absorbed when the bulged parts 40*a*, 40*b*, and 40*c* of the main body 40 are compressed. Secondarily, the load is absorbed when air is discharged from the main body 40 through at least one of the air flow holes 51*a* and 51*b* to the outside.

When a heavy adult uses the exercise step 1, the control part 52 is rotated to open a smaller air flow hole 51*a*. Meanwhile, when a light child uses the exercise step 1, the control part 52 is rotated to open a larger air flow hole 51*b*. Thus, the exercise step 1 of the present invention allows an aircushioning effect to be controlled according to the user's load.

In the exercise step 1 according to the second embodiment of the present invention, a cushioning operation is effectively carried out by the air-cushioning legs 30, thus reducing a shock transmitted to the user's knees, allowing the user to exercise in comfort and safety, and preventing the panel 10 from being deformed by the load. Further, the user may set and confirm a time and the number of steps during exercise.

Further, it is not necessary to provide the air control unit 50 shown in FIG. 8*b*.

Figure 9:
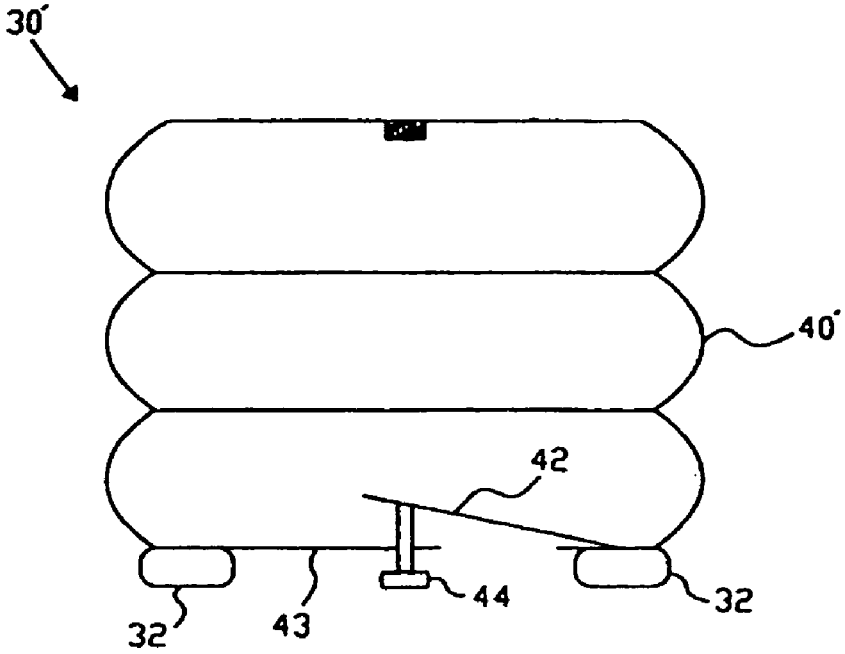
FIG. 9 is a side sectional view of an air-cushioning leg according to a third embodiment of the present invention.

According to a third embodiment shown in FIG. 9, a main body 40' of each air-cushioning leg 30' is designed such that two cover parts 42 and 43 are provided at an open lower part of the main body 40'. In this case, the two cover parts 42 and 43 partially overlap with each other to form an overlapping part. An adjusting bolt 44 is tightened into the overlapping part in such a way that the cover parts 42 and 43 are spaced apart from each other by a predetermined interval, thus controlling the amount of air which flows out of the main body 40'.

Figure 10:
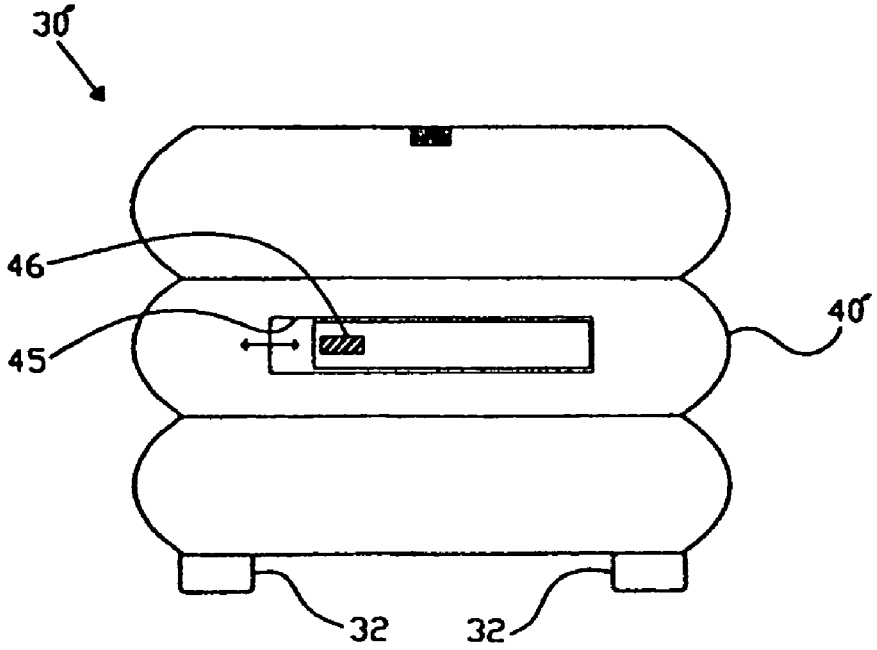
FIG. 10 is a side sectional view of an air-cushioning leg according to a fourth embodiment of the present invention.

According to a fourth embodiment shown in FIG. 10, an air flow opening 45 is provided at a side of a main body 40", and a sliding door 46 is mounted to the air flow opening 45 to control an opening ratio of the air flow opening 45. The main bodies 40' and 40" according to the third and fourth embodiments also have foot parts 32 at the bottom surfaces of the main bodies 40' and 40".

Although not shown in the drawings, several through holes having a predetermined size may be provided in a side of the main body 40 to accomplish a higher cushioning effect.

Figure 11A:
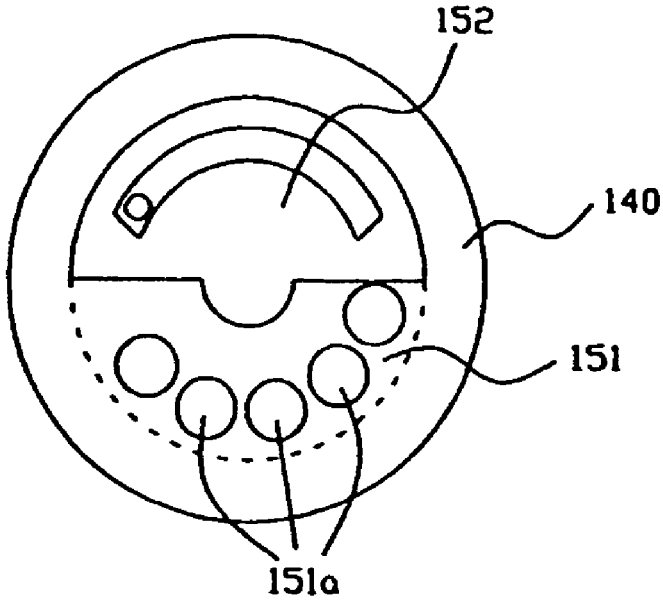
FIGS. 11*a* and 11*b* are plan views of air-cushioning legs according to fifth and sixth embodiments of the present invention, respectively.
Figure 11B:
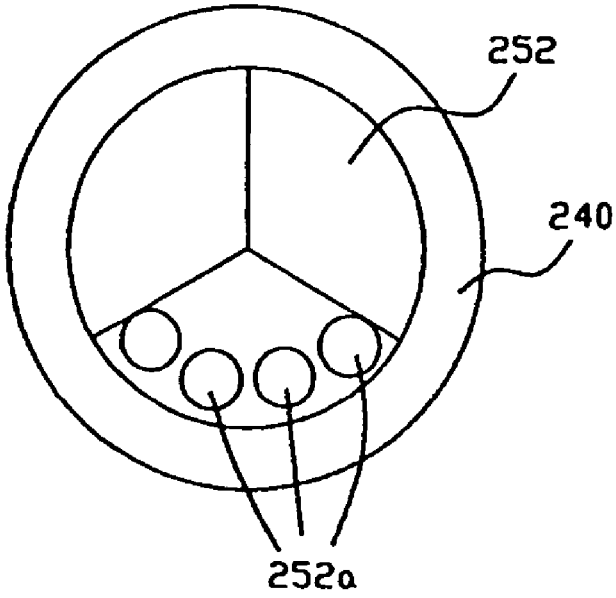

Further, according to a fifth embodiment shown in FIG. 11*a*, a plurality of air flow holes 151*a* are bored through a cover part 151 which is provided at the upper portion of the main body 140. When a control part 152 is rotated, one or more air flow holes 151*a* are opened. Alternatively, the main body of each air-cushioning leg may be designed to have a structure shown in FIG. 11*b*. In FIG. 11*b*, the reference numerals designate components corresponding to those shown in FIG. 11*a* i.e., a control part 252, a main body 240, and air flow holes 252*a*. The components similar to those shown in FIG, 11*a* are not described herein in detail.

Figure 11C:
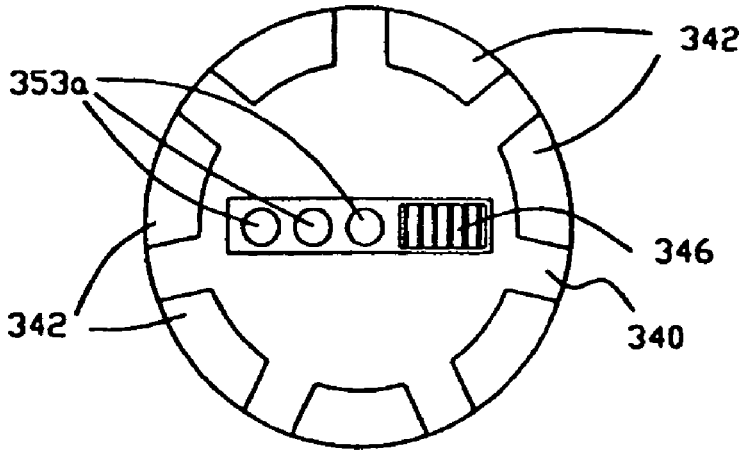
FIG. 11*c* is a bottom view of an air-cushioning leg according to a seventh embodiment of the present invention.

According to the fifth and sixth embodiments of FIG. 11*a* and 11*b*, the air flow holes 151*a* and 252*a* are provided at the upper portions of the main bodies 140 and 240, respectively. However, air flow holes may be formed as shown in FIG. 11*c*, to accomplish the same effect as the air flow holes 151*a* and 252*a* of FIGS. 11*a* and 11*b*. That is, according to a seventh embodiment of FIG. 11*c*, a plurality of air flow holes 353*a* are provided in the bottom surface of a main body 340, and a sliding door 346 is provided to selectively open or close the air flow holes 353*a*, thus controlling an opening ratio of the air flow holes 353*a*. Further, foot parts 342 according to the seventh embodiment of the present invention are radially arranged on the bottom surface of the main body 340, differently from the above embodiments.

Figure 12:
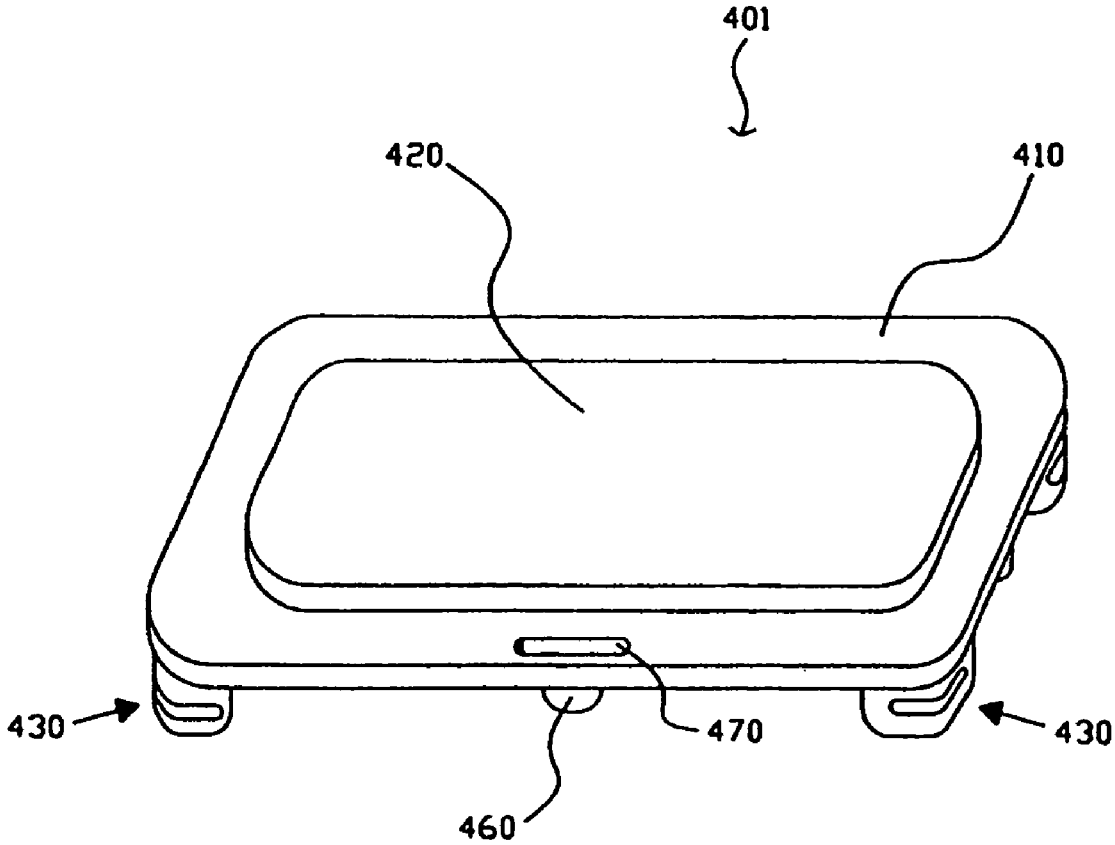
FIG. 12 is a perspective view of an exercise step according to an eighth embodiment of the present invention.

FIG. 12 shows an exercise step according to an eighth embodiment of the present invention The exercise step 401 includes a panel 410. A foot contact plate 420 is provided on a top surface of the panel 410. A handle 470 is provided on the top surface of the panel 410 around the foot contact plate 420. A plurality of air-cushioning legs 430 are provided on four comers of the panel 410 under the panel 410.

Figure 13:
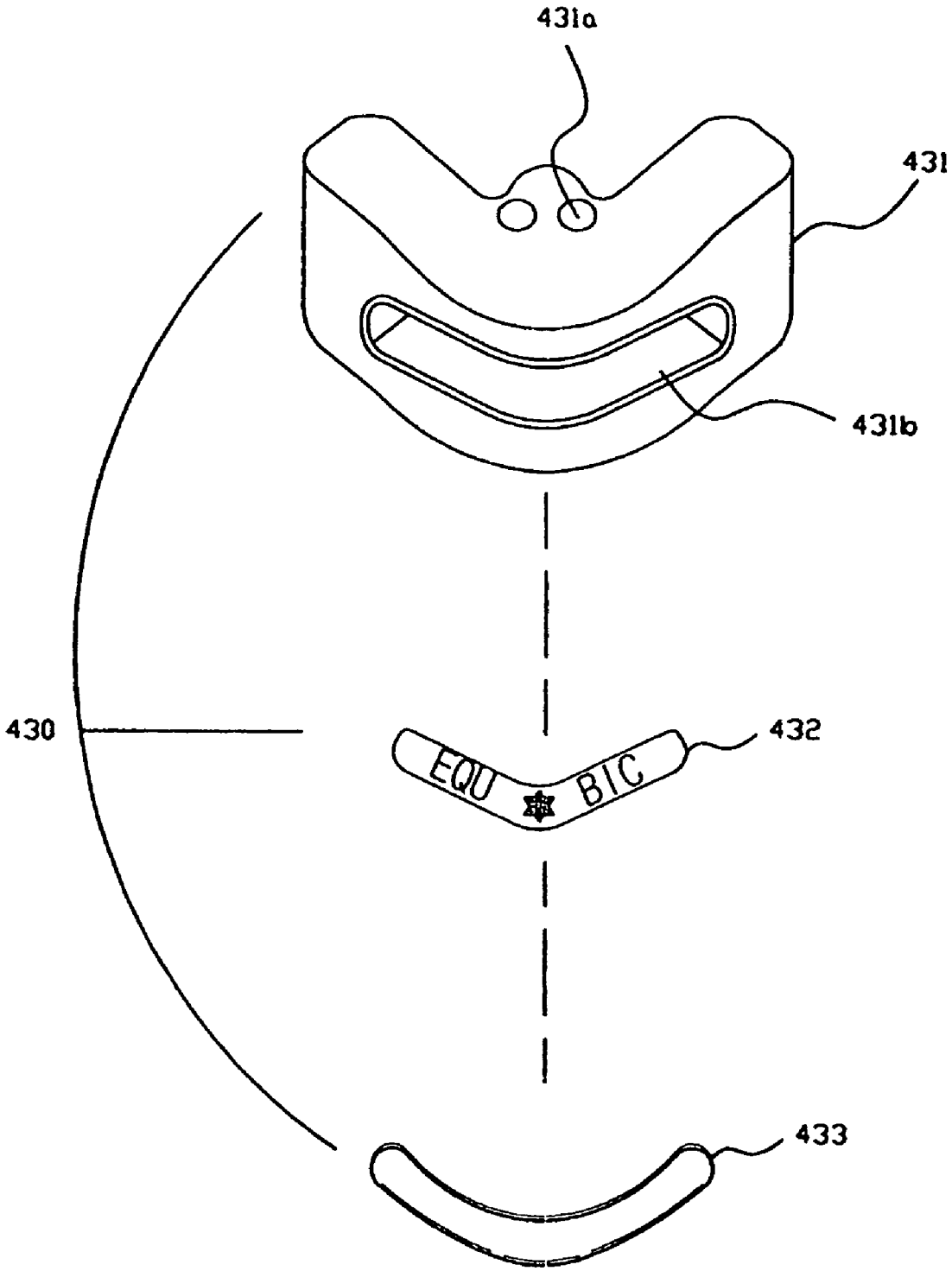
FIG. 13 is an exploded perspective view of one of air-cushioning legs included in the exercise step shown in FIG. 12.

As shown in FIG. 13, each of the air-cushioning legs 430 includes a body 431 and an air cushioning tube 433. The body 431 is made of an elastic material, such as thermoplastic polyurethane. The air cushioning, tube 433 is installed in the body 431. A recess 431*b* is provided at a side of the body 431. A plurality of air cushioning holes 431*a* are vertically formed in the body 431 to accomplish a higher air cushioning effect.

The air cushioning tube 433 is installed in the recess 431*b* to absorb a load applied to the panel 410, in cooperation with the body 431. The air cushioning tube 433 may be fabricated in the form of a sealed tube with which air is filled. Further, the air cushioning tube 433 may be made of transparent thermoplastic polyurethane, thus allowing people to see an advertising member 432 which will be later described herein. Two or more air cushioning tubes may be installed in the recess of the body, differently from the air-cushioning leg 430 shown in FIG. 13.

The advertising member 432 is provided between the inside wall of the recess 431*b* and the air cushioning tube 433. The advertising member 432 comprises a notice for advertising an article. However, the air-cushioning leg 430 may not be provided with the advertising member 432.

Figure 14:
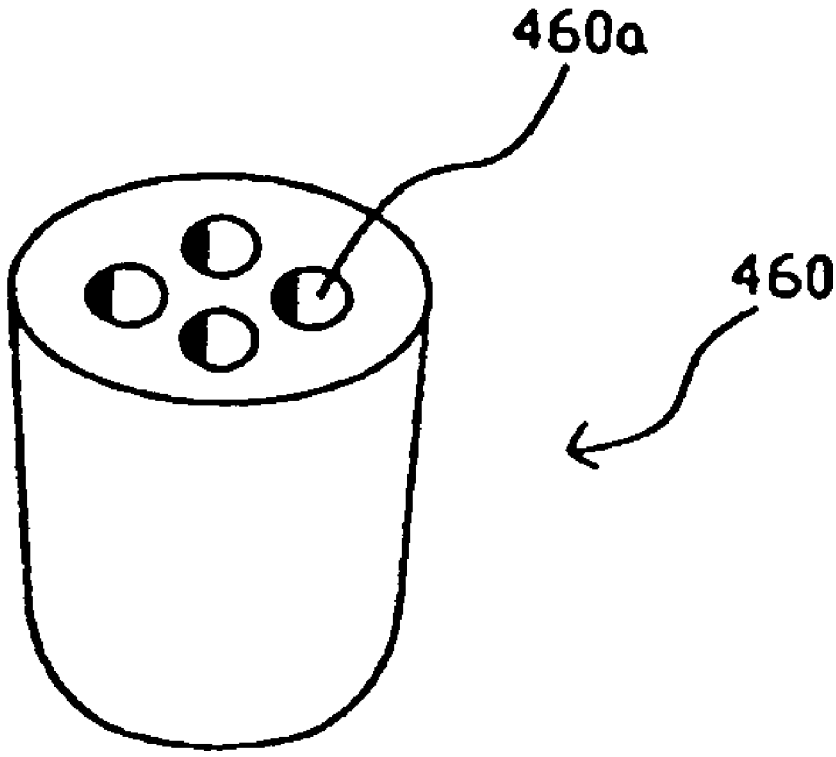
FIG. 14 is a perspective view of a sub-support leg included in the exercise step shown in FIG. 12.

Sub-support legs 460 are provided between the air-cushioning legs 430 to elastically absorb the load applied to the panel 410, in cooperation with the air-cushioning legs 430 (see, FIG. 14). Each sub-support leg 460 is made of an elastic material, such as thermoplastic polyurethane. Air cushioning holes 460*a* are formed at each sub-support leg 460 to accomplish a higher air cushioning effect.

Each sub-support leg 460 is shorter in length than each of the air-cushioning legs 430. Thus, when the exercise step 401 according to the eighth embodiment of the present invention is placed on a flat surface, the air-cushioning legs 430 are in contact with the support surface, but the sub-support legs 460 are spaced apart from the support surface.

When a strain of the panel 410 exceeds a reference level due to an excessive load, the sub-support legs 460 come into contact with the support surface, thus preventing the strain of the panel 410 from exceeding an elastic limit. Meanwhile, the air cushioning holes 460*a* formed in each sub-support leg 460 function to increase the elastic strain of the panel 10.

The exercise step 401 according to the eighth embodiment of the present invention is provided with the body 431, the air cushioning holes 431*a* formed on. the body 431, the air cushioning tube 433, the sub-support legs 460, and the air cushioning holes 460*a* formed on the sub-support legs 460, thus enhancing an air cushioning effect, therefore preventing a shock from being transmitted to a user's knees, and allowing the user to exercise in comfort and safety, like the exercise steps according to the above-mentioned embodiments.

According to the above-mentioned embodiments of the present invention, each air-cushioning leg 30 includes the main body 40 and the air control unit 50. In this case, since the main body 40 has a three-layered structure and is made of thermoplastic polyurethane having a relatively high elastic force, a sufficient cushioning effect is accomplished using only the main body 40 of each air-cushioning leg 30. However, when each air-cushioning leg 30 includes the air control unit 50 as well as the main body 40, the cushioning effect of the exercise step 1 is maximized.

According to the above-mentioned embodiments, the panel 10 is made of a laminated compressed wood. However, the panel 10 may be made of wood having elasticity or other elastic materials. Further, the panel 10 has a rectangular or circular shape, but the panel may have other shapes.

According to the above-mentioned embodiments, the foot contact plate 20 is provided on the top surface of the panel 10. But, the panel 10 may not be provided with the foot contact plate 20.

According to the above-mentioned embodiments, the air-cushioning legs 30 are provided under the panel 10 to support the panel 10, and function to absorb a load applied to the panel 10 during an exercise. However, the air-cushioning legs 30 are not necessarily provided at the panel 10. That is, the air-cushioning legs may be mounted to support legs (not shown) of a bed or a chair to achieve a cushioning effect. Since the air-cushioning legs mounted to the support legs have the same construction as the air-cushioning legs 30 of the above-mentioned embodiments, the air-cushioning legs are not described in the following.

Although not shown in the drawings, in place of the air control unit according to the above-mentioned embodiments, an air inlet port and an air outlet port may be provided at both sides of the main body and a damper may be provided at the air outlet port to control an opening ratio of the air outlet port, thus having the same effect as the air control unit of the above-mentioned embodiments.

Industrial Applicability

As described above, the present invention provides an exercise step, which has an excellent cushioning effect, thus preventing a shock from being transmitted to a user's knees and allowing the user to exercise in comfort and safety.

Further, the present invention provides an exercise step, which is capable of minimizing noise generated during a cushioning operation, and has an excellent cushioning effect. The exercise step of the present invention has a more excellent cushioning effect, in comparison with a conventional exercise step, thus preventing a panel from being deformed and thereby having a long life-span.

The present invention provides an exercise step, which is provided with a display unit, thus allowing a user to confirm the number of steps and a time during an exercise.

Although the preferred embodiments of the present invention have been disclosed for illustrative purposes, those skilled in the. art will appreciate that various modifications, additions and substitutions are possible, without departing from the scope and spirit of the invention as disclosed in the accompanying claims.

The invention claimed is:

1. An exercise step, comprising:

a plate-shaped panel; and an air-cushioning leg provided under the panel to support the panel, and absorbing a load applied to the panel by an air cushioning effect, wherein said air-cushioning leg comprises:

a main body, including:

a plurality of tubular bulged parts having different load absorbing capacities, said bulged parts being arranged to form a layered structure;

a closed base part coming into contact with a support surface; and an upper end partially opened to define an air passage;

an air control unit seated in the open part of the upper end to control an amount of air which flows into and out of the main body; and a cover member covering the upper end of the main body in which the air control unit is seated.

2. The exercise step according to claim 1, wherein said open part of the upper end of the main body comprises:

a central opening formed at a center of the upper end of the main body; and a plurality of radial slits provided along a circumference of the upper end of the main body at predetermined intervals, and communicating with the central opening.

3. The exercise step according to claim 2, wherein said air control unit comprises:

a control body seated in the central opening; and a plurality of flanges outwardly extending from the control body in a radial direction to be seated in the radial slits, whereby said air control unit controls the amount of air which flows in and out the main body.

4. The exercise step according to claim 3, wherein at least one through hole is provided in the control body to additionally control the amount of air which flows in and out the main body.

5. The exercise step according to claim 1, wherein said air control unit is made of porous material.

6. The exercise step according to claim 1, wherein said bulged parts comprise:

a first bulged part provided adjacent to the base part of the main body; and a second bulged part placed on the first bulged part to form a layered structure, said second bulged part being smaller in diameter than the first bulged part.

7. An exercise step, comprising:

a plate-shaped panel; and an air-cushioning leg provided under the panel to support the panel, and absorbing a load applied to the panel by an air cushioning effect, wherein said air-cushioning leg comprises:

a main body having a two or more layered structure, the main body having an upper end and an open part in the upper end comprising a two-way air passage between the main body and an outside of the exercise step; and an air control unit functioning to allow two-way passage of air through the two-way air passage to discharge and charge a part of cushioning air from the main body to and from the outside during use, wherein said air control unit comprises porous material.

8. The exercise step according to claim 7, wherein said open part of the upper end of the main body comprises:

a central opening formed at a center of the upper end of the main body; and a plurality of radial slits provided along a circumference of the upper end of the main body at predetermined intervals, and communicating with the central opening.

9. The exercise step according to claim 7, wherein three or more air-cushioning legs are provided under the panel to support the panel.

10. The exercise step according to claim 7, wherein said main body comprises bulged parts, said bulged parts being layered in a vertical direction.

11. The exercise step according to claim 10, wherein the bulged parts comprise different load absorbing capacities.

* * * * *